US010717115B2

(12) United States Patent
Ortmann et al.

(10) Patent No.: US 10,717,115 B2
(45) **Date of Patent: *Jul. 21, 2020**

(54) METHODS OF USING ENZYME COMPOSITIONS

(71) Applicant: Ecolab USA Inc., St. Paul, MN (US)

(72) Inventors: Nathan R. Ortmann, Buffalo, MN (US); Katherine Vetter, West St. Paul, MN (US); Thomas R. Mohs, Eagan, MN (US); Anthony W. Erickson, Golden Valley, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/669,328

(22) Filed: Aug. 4, 2017

(65) Prior Publication Data

US 2017/0333956 A1 Nov. 23, 2017

Related U.S. Application Data

(63) Continuation of application No. 14/806,116, filed on Jul. 22, 2015, now Pat. No. 9,738,857, which is a continuation of application No. 13/736,809, filed on Jan. 8, 2013, now Pat. No. 9,133,420.

(51) Int. Cl.

| | |
|---|---|
| ***C11D 3/386*** | (2006.01) |
| ***B08B 3/08*** | (2006.01) |
| ***C11D 1/66*** | (2006.01) |
| ***B08B 3/10*** | (2006.01) |
| ***C11D 11/00*** | (2006.01) |

(52) U.S. Cl.

CPC ..... *B08B 3/08* (2013.01); *B08B 3/10* (2013.01); *C11D 1/66* (2013.01); *C11D 3/38609* (2013.01); *C11D 3/38618* (2013.01); *C11D 11/0023* (2013.01)

(58) Field of Classification Search

CPC .... B08B 3/08; B08B 3/10; C11D 1/66; C11D 3/10; C11D 3/38609; C11D 3/38618; C11D 11/0023

See application file for complete search history.

(56) References Cited

U.S. PATENT DOCUMENTS

| | | | | |
|---|---|---|---|---|
| 4,087,368 | A * | 5/1978 | Borrello | C11D 3/38672 435/187 |
| 4,238,345 | A | 12/1980 | Guilbert | |
| 4,711,739 | A | 12/1987 | Kandathil | |
| 5,288,421 | A | 2/1994 | Mandy | |
| 5,429,765 | A | 7/1995 | Flower | |
| 5,529,788 | A | 6/1996 | De Senna | |
| 5,691,292 | A | 11/1997 | Marshall et al. | |
| 5,861,366 | A | 1/1999 | Ihns et al. | |
| 5,898,025 | A | 4/1999 | Burg et al. | |
| 5,902,781 | A | 5/1999 | Painter | |
| 5,958,871 | A | 9/1999 | Clare | |
| 5,977,047 | A | 11/1999 | Carr | |
| 5,990,065 | A | 11/1999 | Vinson et al. | |
| 5,998,342 | A * | 12/1999 | Scoville, Jr. | C11D 1/94 134/42 |
| 6,069,122 | A | 5/2000 | Vinson et al. | |
| 6,258,591 | B1 | 7/2001 | Yoneda et al. | |
| 6,333,301 | B1 | 12/2001 | Kamiya | |
| 6,608,016 | B2 | 8/2003 | Singh | |
| 6,638,902 | B2 | 10/2003 | Tarara et al. | |
| 6,649,401 | B2 | 11/2003 | Tisinger et al. | |
| 6,720,298 | B2 | 4/2004 | Blything et al. | |
| 6,759,380 | B2 | 7/2004 | Singh et al. | |
| 6,767,881 | B1 * | 7/2004 | Griese | C11D 1/72 510/101 |
| 6,815,404 | B2 | 11/2004 | Becker | |
| 7,033,645 | B2 | 4/2006 | Gatto et al. | |
| 7,393,528 | B2 | 7/2008 | Tvedten | |
| 7,928,047 | B2 | 4/2011 | Cho et al. | |
| 8,097,047 | B2 | 1/2012 | Sivik et al. | |
| 9,133,420 | B2 | 9/2015 | Ortmann | |
| 2002/0123447 | A1 | 9/2002 | Manski et al. | |
| 2002/0132746 | A1 | 9/2002 | Desenna et al. | |
| 2002/0177541 | A1 * | 11/2002 | Tarara | C11D 3/10 510/392 |
| 2002/0182184 | A1 | 12/2002 | Pearl et al. | |
| 2003/0049832 | A1 | 3/2003 | Tisinger et al. | |
| 2003/0109403 | A1 | 6/2003 | Man et al. | |

(Continued)

FOREIGN PATENT DOCUMENTS

| | | | | |
|---|---|---|---|---|
| EP | 1 356 016 | B1 | 12/2001 | |
| EP | 1 337 228 | B1 | 6/2002 | |
| EP | 1356016 | B1 * | 9/2006 | C11D 3/10 |
| EP | 1 392 218 | B1 | 11/2006 | |
| GB | 2360041 | A * | 9/2001 | C11D 3/2003 |
| JP | 04023898 | A | 1/1992 | |
| WO | WO 01/76647 | | 10/2001 | |
| WO | WO 2002/061026 | A1 | 8/2002 | |
| WO | WO 2002/094181 | A2 | 11/2002 | |
| WO | WO 2003/003976 | A2 | 1/2003 | |
| WO | WO 2008/084237 | A2 | 7/2008 | |
| WO | WO 2008/089066 | A1 | 7/2008 | |

OTHER PUBLICATIONS

Dow Chemical Company Technical Data Sheet, Triton™ DF-12 Surfactant, http://www.dow.com/products/#/product-line/triton/product/triton-df-as/?&_suid=135594382767704928354302113450 7, 1 page, undated.

Dow Chemical Company Material Safety Data Sheet, Triton™ DF-12 Surfactant, 8 pages, Apr. 3, 2012.

Nonyl Phenol Ethoxylate (NPE), Arak Petrochemical Company, http://www.arpc.it/Portals/0/Pdf/Products/Chemical/npe.pdf, accessed Dec. 16, 2013.

International Search Report and Written Opinion for PCT/US2014/010446 dated May 14, 2014.

*Primary Examiner* — Sharidan Carrillo

(74) *Attorney, Agent, or Firm* — Merchang & Gould P.C.

(57) ABSTRACT

The present disclosure relates to compositions and methods for cleaning medical and dental instruments. The disclosed compositions are preferably non-foaming or generate low foam to allow visual inspection of the cleaning process as well as safe handling of the instruments. The disclosed compositions preferably employ select proteases, a carbonate and a nonionic surfactant.

12 Claims, No Drawings

(56) References Cited

U.S. PATENT DOCUMENTS

| | | | | |
|---|---|---|---|---|
| 2003/0176307 | A1 | 9/2003 | Housmekerides et al. | |
| 2004/0072714 | A1 | 4/2004 | Tarara et al. | |
| 2004/0097394 | A1 | 5/2004 | Burrows et al. | |
| 2004/0126436 | A1 | 7/2004 | Cagle et al. | |
| 2005/0020466 | A1 | 1/2005 | Man | |
| 2005/0036990 | A1 | 2/2005 | Tisinger et al. | |
| 2008/0023031 | A1 | 1/2008 | Kellar et al. | |
| 2008/0171001 | A1 | 7/2008 | Engelman et al. | |
| 2008/0274931 | A1 | 11/2008 | Pham | |
| 2009/0054287 | A1 | 2/2009 | Smith et al. | |
| 2010/0028372 | A1 | 2/2010 | Jezek | |
| 2010/0144578 | A1 | 6/2010 | Smith et al. | |
| 2011/0174340 | A1* | 7/2011 | Choczaj | C11D 3/386 134/26 |
| 2011/0257064 | A1 | 10/2011 | Brooker et al. | |
| 2012/0053110 | A1 | 3/2012 | Kiesel et al. | |
| 2012/0108484 | A1 | 5/2012 | Becker et al. | |
| 2017/0333956 | A1* | 11/2017 | Ortmann | C11D 3/10 |
| 2018/0334640 | A1* | 11/2018 | Bartelme | C11D 1/04 |

* cited by examiner

METHODS OF USING ENZYME COMPOSITIONS

CROSS-REFERENCE TO RELATED APPLICATIONS

This application is a continuation of application Ser. No. 14/806,116, filed Jul. 22, 2015, now U.S. Pat. No. 9,738,857, which is a continuation of application Ser. No. 13/736,809, filed Jan. 8, 2013, now U.S. Pat. No. 9,133,420, which applications are incorporated herein by reference in their entirety.

BACKGROUND

In the health care industry, medical instruments must be thoroughly cleaned and sanitized before being reused. Cleaning processes include multiple steps where some steps may be automated and some steps may be manual. The instruments cleaned may be heavily soiled with protein and fat based soils, or sharp, small or irregular shaped. It is against this background that the present disclosure is made.

SUMMARY

Surprisingly, it has been discovered that the disclosed compositions and methods are effective at removing the soils on surfaces, such as medical and dental instruments. Further, when used as a manual pre-treatment composition, the compositions advantageously do not produce foam. The disclosed compositions are stable as solids and operable over a pH and temperature range.

In some aspects, the present disclosure relates to methods of cleaning articles using the disclosed compositions. In some embodiments, the articles are instruments. In some embodiments, the cleaning compositions are formed by dissolving at least a portion of a solid composition with water. The solid compositions can include a source of alkalinity, a nonioinic surfactant, a protease enzyme, and other functional ingredients. In some embodiments, the cleaning compositions are diluted to form a use solution. An article is then submerged in the use solution and allowed to remain there for a period of time. The article is then removed from the use solution and then optionally further treated. In some embodiments, the cleaning compositions produce low foam or no foam at all. In some embodiments, the method employing the cleaning compositions removes both protein and fat.

These and other embodiments will be apparent to those skilled in the art and others in view of the following description of some embodiments. It should be understood that this summary and the detailed description illustrate only some examples of various embodiments and are not intended to be limiting to the claimed invention.

DETAILED DESCRIPTION

The present disclosure is directed to compositions and methods that are effective at removing the soils on medical and dental instruments. The disclosed composition provide low foam or no foam allowing for visual inspection of the articles to monitor the cleaning process and provide safe handling of the articles. Finally, the compositions are stable as solids, and operate over a wide range of pH and temperatures including neutral pH and low temperatures.

Cleaning Compositions

The disclosed compositions include at least one protease enzyme, a source of alkalinity, a surfactant, and optional additional functional ingredients. The cleaning compositions may be formulated as a use solution or as concentrated products that are diluted or dissolved to form a use composition, which is then applied to the surface of the article. A concentrated product refers to a product that is diluted to form a use solution before it is applied to a surface. A use solution refers to the product that is applied to a surface.

The concentrate product may be made in many forms, including as a solid such as a powder, a flake, a granule, a pellet, a tablet, a lozenge, a puck, a briquette, a brick, a solid block, a unit dose, or another solid form known to those of skill in the art. The concentrate product may also be formulated as a liquid, a thickened liquid, or a gel. The concentrate product may also be formulated to have more than one form. The following tables include exemplary concentration ranges for materials in both the concentrated product and the use solution.

Exemplary Concentration Ranges for the Concentrated Product

| | Exemplary Concentration Ranges | | |
|---|---|---|---|
| protease | 0.1 to 30 wt. % | 1 to 25 wt. % | 2 to 20 wt. % |
| source of alkalinity | 0.1 to 50 wt. % | 1 to 40 wt. % | 2 to 35 wt. % |
| surfactant | 0 to 30 wt. % | 1 to 20 wt. % | 5 to 15 wt. % |
| chelating or sequestering agent | 0 to 30 wt. % | 0 to 20 wt. % | 0 to 15 wt. % |
| corrosion inhibitor | 0 to 20 wt. % | 0 to 15 wt. % | 0 to 10 wt. % |
| other enzymes | 0 to 20 wt. % | 0 to 10 wt. % | 0 to 5 wt. % |
| solidification agent | 0 to 50 wt. % | 0 to 40 wt. % | 0 to 30 wt. % |
| preservative | 0 to 5 wt. % | 0 to 2 wt. % | 0 to 1 wt. % |
| defoamer | 0 to 40 wt. % | 0 to 30 wt. % | 0 to 20 wt. % |
| dye | 0 to 10 wt. % | 0 to 5 wt. % | 0 to 1 wt. % |
| fragrance | 0 to 10 wt. % | 0 to 5 wt. % | 0 to 1 wt. % |

Exemplary Concentration Ranges for the Use Solution Product

| | Exemplary Concentration Ranges | | |
|---|---|---|---|
| protease | about 0.0001 to about 2 wt. % | about 0.0005 to about 0.1 wt. % | about 0.001 to about 0.008 wt. % |
| source of alkalinity | about 0.0007 to about 20 wt. % | about 0.007 to about 1.0 wt. % | about 0.01 to about 0.15 wt. % |
| surfactant | 0 to about 2 wt. % | 0 to about 0.5 wt. % | 0 to about 0.05 wt. % |
| chelating or sequestering agent | 0 to about 5 wt. % | 0 to about 0.5 wt. % | 0 to about 0.10 wt. % |
| corrosion inhibitor | 0 to about 1 wt. % | 0 to about 0.1 wt. % | 0 to about 0.01 wt. % |
| other enzymes | about 0.0001 to about 2 wt. % | about 0.0005 to about 0.1 wt. % | about 0.001 to about 0.008 wt. % |
| solidification agent | 0 to about 5 wt. % | 0 to about 1 wt. % | 0 to about 0.10 wt. % |
| preservative | 0 to about 1 wt. % | 0 to about 0.1 wt. % | 0 to about 0.005 wt. % |

-continued

| | Exemplary Concentration Ranges | | |
|---|---|---|---|
| defoamer | 0 to about 5 wt. % | 0 to about 0.5 wt. % | 0 to about 0.10 wt. % |
| dye | 0 to about 1 wt. % | 0 to about 0.1 wt. % | 0 to about 0.01 wt. % |
| fragrance | 0 to about 1 wt. % | 0 to about 0.1 wt. % | 0 to about 0.01 wt. % |
| water | 0 to about 99.999 wt. % | 0 to about 99.992 wt. % | 0 to about 98.9 wt. % |

As used herein, weight percent, percent by weight, % by weight, and the like are synonyms that refer to the concentration of a substance as the weight of that substance divided by the weight of the composition and multiplied by 100.

In some embodiments, the composition is free or substantially free of a defoamer. In some embodiments the composition is free or substantially free from surfactant, which sometimes creates foam. Some embodiments of the disclosed compositions do not rely on surfactants for soil removal, which means that lower levels of surfactants can be used and a defoamer is not necessary. In some embodiments, the use composition does not generate foam. In some embodiments, the composition is free or substantially free of anionic surfactant. In some embodiments, the disclosed compositions can include surfactants, including anionic surfactants. In compositions with surfactants, foam generation can be controlled for example, by limiting the amount of anionic surfactant in the cleaning composition or use composition, by controlling the amount of anionic surfactant relative to other materials in the composition such as the solidifying agent, by using a nonionic surfactant together with any anionic surfactant, or by including a foam control or defoaming agent.

The use solution preferably has a pH in the range of 5 to 11, 6 to 10, or 7 to 9.

Source of Alkalinity

The disclosed compositions include a source of alkalinity including at least one carbonate. Exemplary sources of carbonate include sodium carbonate, potassium carbonate, sodium bicarbonate, potassium bicarbonate, sesquicarbonate, trona or trisodium hydrogendicarbonate dihydrate, and mixtures thereof. The carbonate is preferably sodium bicarbonate.

In addition to the source of carbonate, the disclosed compositions may optionally include a secondary source of alkalinity such as a hydroxide or a silicate. Exemplary hydroxides include sodium hydroxide, potassium hydroxide, and lithium hydroxide. Exemplary silicates include alkaline metal silicates including alkali metal ortho, meta-, di-, tri-, and tetrasilicates such as sodium orthosilicate, sodium sesquisilicate, sodium sesquisilicate pentahydrate, sodium metasilicate, sodium metasilicate pentahydrate, sodium metasilicate hexahydrate, sodium metasilicate octahydrate, sodium metasilicate nanohydrate, sodium disilicate, sodium trisilicate, sodium tetrasilicate, potassium metasilicate, potassium metasilicate hemihydrate, potassium silicate monohydrate, potassium disilicate, potassium disilicate monohydrate, potassium tetrasilicate, potassium tetrasilicate monohydrate, or mixtures thereof.

Surfactant

The disclosed compositions optionally include a surfactant. The surfactant can be selected from nonionic, semipolar nonionic, anionic, cationic, amphoteric, or zwitterionic surface-active agents, or any combination thereof. In some embodiments, the surfactant is low-foaming or nonfoaming. Including a surfactant has been found to assist with fat removal on instruments and devices.

Preferred surfactants have good cleaning performance without generating undesired levels of foam. Nonionic surfactants have been found to provide the desired cleaning performance without the foam generation. Preferred surfactants have a cloud point that is higher than the use temperature of the disclosed compositions. If surfactants are selected and used above their cloud point, they will provide soil removal as well as defoaming properties to the composition. In order to take advantage of the cleaning and defoaming characteristics of the surfactant, the surfactant preferably has a cloud point between 10-50° C., 15-40° C., or 20-35° C.

Nonionic Surfactants

Nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

A particularly preferred nonionic surfactant is the linear alcohol ethoxylate surfactant. Preferred linear alcohol ethoxylates have between 6 and 20, 7 and 15, or 8 and 10 carbon atoms and 2 to 14, 3 to 10, or 3 to 7 moles of ethoxylation. An example of a commercially available linear alcohol ethoxylate is Triton DF-12, which is commercially available from Dow. Other exemplary nonionic surfactants include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from 1,000 to 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrophobe ranges from 500 to 7,000; and, the hydrophile, ethylene oxide, is added to constitute from 10% by weight to 80% by weight of the molecule.

2. Condensation products of one mole of alkyl phenol wherein the alkyl chain, of straight chain or branched chain configuration, or of single or dual alkyl constituent, contains from 8 to 18 carbon atoms with from 3 to 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from 6 to 24 carbon atoms with from 3 to 50 moles of ethylene oxide. The alcohol moiety can consist of mixtures of alcohols in the above delineated carbon range or it can consist of an alcohol having a specific number of carbon atoms within this range. Examples of like commercial surfactants are available under the trade names Neodol® manufactured by Shell Chemical Co. and Alfonic® manufactured by Vista Chemical Co.

4. Condensation products of one mole of saturated or unsaturated, straight or branched chain carboxylic acid having from 8 to 18 carbon atoms with from 6 to 50 moles of ethylene oxide. The acid moiety can consist of mixtures of acids in the above defined carbon atom range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols can be used. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from 1,000 to 3,100 with the central hydrophile including 10% by weight to 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from 2,100 to 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

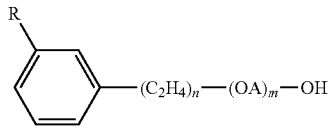

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from 1 to 6 carbon atoms and one reactive hydrogen atom, n has an average value of at least 6.4, as determined by hydroxyl number and m has a value such that the oxyethylene portion constitutes 10% to 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ wherein Y is the residue of an organic compound having from 2 to 6 carbon atoms and containing x reactive hydrogen atoms in which x has a value of at least 2, n has a value such that the molecular weight of the polyoxypropylene hydrophobic base is at least 900 and m has value such that the oxyethylene content of the molecule is from 10% to 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional useful conjugated polyoxyalkylene surface-active agents correspond to the formula: $P[(C_3H_6O)_n$ $(C_2H_4O)_mH]_x$ wherein P is the residue of an organic compound having from 8 to 18 carbon atoms and containing x reactive hydrogen atoms in which x has a value of 1 or 2, n has a value such that the molecular weight of the polyoxyethylene portion is at least 44 and m has a value such that the oxypropylene content of the molecule is from 10% to 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants include those having the structural formula $R^2CONR^1Z$ in which: $R^1$ is H, $C_1$-$C_4$ hydrocarbyl, 2-hydroxy ethyl, 2-hydroxy propyl, ethoxy, propoxy group, or a mixture thereof; $R^2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction, such as a glycityl moiety.

9. The alkyl ethoxylate condensation products of aliphatic alcohols with from 0 to 25 moles of ethylene oxide are suitable. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants, particularly those that are water soluble. Suitable ethoxylated fatty alcohols include the $C_{10}$-$C_{18}$ ethoxylated fatty alcohols with a degree of ethoxylation of from 3 to 50.

11. Exemplary nonionic alkylpolysaccharide surfactants include those disclosed in U.S. Pat. No. 4,565,647, Llenado, issued Jan. 21, 1986. These surfactants include a hydrophobic group containing from 6 to 30 carbon atoms and a polysaccharide, e.g., a polyglycoside, hydrophilic group containing from 1.3 to 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or —$(C_2H_4O)_xH$, where x is in the range of from 1 to 3.

13. Nonionic surfactants also include the class defined as alkoxylated amines or, most particularly, alcohol alkoxylated/aminated/alkoxylated surfactants. These nonionic surfactants may be at least in part represented by the general formulae:

$$R^{20}—(PO)_sN\text{-}(EO)_tH,$$

$$R^{20}—(PO)_sN\text{-}(EO)_tH(EO)_tH, \text{ and}$$

$$R^{20}—N(EO)_tH;$$

in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, and t is 1-10, preferably 2-5. Other variations on the scope of these compounds may be represented by the alternative formula:

$$R^{20}—(PO)_v—N[(EO)_wH][(EO)_zH]$$

in which $R^{20}$ is as defined above, v is 1 to 20 (e.g., 1, 2, 3, or 4 (preferably 2)), and w and z are independently 1-10, preferably 2-5.

These compounds are represented commercially by a line of products sold by Huntsman Chemicals as nonionic surfactants. A preferred chemical of this class includes Surfonic™ PEA 25 Amine Alkoxylate.

The treatise Nonionic Surfactants, edited by Schick, M. J., Vol. 1 of the Surfactant Science Series, Marcel Dekker, Inc., New York, 1983 is a reference on the wide variety of nonionic compounds. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactants

The semi-polar type of nonionic surface active agents are another class of useful nonionic surfactants. The semi-polar nonionic surfactants include the amine oxides, phosphine oxides, sulfoxides and their alkoxylated derivatives.

14. Amine oxides are tertiary amine oxides corresponding to the general formula:

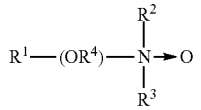

wherein the arrow is a conventional representation of a semi-polar bond; and $R^1$, $R^2$, and $R^3$ may be aliphatic, aromatic, heterocyclic, alicyclic, or combinations thereof. Generally, for amine oxides of detergent interest, $R^1$ is an alkyl radical of from 8 to 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to 20.

Water soluble amine oxide surfactants are selected from the coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Semi-polar nonionic surfactants also include the water soluble phosphine oxides having the following structure:

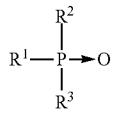

wherein the arrow is a conventional representation of a semi-polar bond; and $R^1$ is an alkyl, alkenyl or hydroxyalkyl moiety ranging from 10 to 24 carbon atoms in chain length; and $R^2$ and $R^3$ are each alkyl moieties separately selected from alkyl or hydroxyalkyl groups containing 1 to 3 carbon atoms.

Examples of phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants also include the water soluble sulfoxide compounds which have the structure:

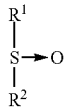

wherein the arrow is a conventional representation of a semi-polar bond; and, $R^1$ is an alkyl or hydroxyalkyl moiety of 8 to 28 carbon atoms, from 0 to 5 ether linkages and from 0 to 2 hydroxyl substituents; and $R^2$ is an alkyl moiety consisting of alkyl and hydroxyalkyl groups having 1 to 3 carbon atoms.

These sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Anionic Surfactants

Anionic surfactants are categorized as anionics because the charge on the hydrophobe is negative or the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

Anionics are excellent detersive surfactants. Because anionics can generate foam in the disclosed applications, it may be desirable to control the foam, for example, by limiting the amount of anionic surfactant in the overall composition, by controlling the amount of anionic surfactant relative to other materials in the composition such as the solidification agent, by using a nonionic surfactant together with the anionic surfactant, or by including a foam control or defoaming agent.

Anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989). The first class includes acylamino acids (and salts), such as acylglutamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl)glucamine sulfates, and sulfates of alkylpolysaccharides such as the sulfates of alkylpolyglucoside.

Examples of synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants include the alkyl ethoxy carboxylates, the alkyl polyethoxy polycarboxylate surfactants and the soaps (e.g. alkyl carboxyls). Secondary soap surfactants (e.g. alkyl carboxyl surfactants) include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic surfactants include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy)ether sulfates and aromatic poly(ethyleneoxy)sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Cationic Surfactants

Surface active substances are classified as cationic if the charge on the hydrophobe portion of the molecule is positive. Surfactants in which the hydrophobe carries no charge unless the pH is lowered close to neutrality or lower, but which are then cationic (e.g. alkyl amines), are also included in this group. In theory, cationic surfactants may be synthesized from any combination of elements containing an "onium" structure $R_nX^+Y^-$— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

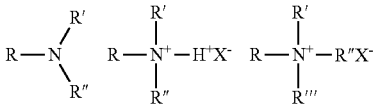

in which, R represents a long alkyl chain, R', R", and R'" may be either long alkyl chains or smaller alkyl or aryl groups or hydrogen and X represents an anion. The amine salts and quaternary ammonium compounds are preferred for their high degree of water solubility.

The majority of large volume commercial cationic surfactants can be subdivided into four major classes and additional sub-groups known to those of skill in the art and described in "Surfactant Encyclopedia," Cosmetics & Toiletries, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

In the disclosed compositions, cationic surfactants are carefully selected to be compatible with the enzymes. Some cationic surfactants, including some antimicrobial quaternary ammonium compounds, are known to reduce or eliminate enzyme activity. Cationic surfactants such as these are preferably either avoided or minimized.

Useful cationic surfactants include those having the formula $R^1{}_mR^2{}_xYLZ$ wherein each $R^1$ is an organic group containing a straight or branched alkyl or alkenyl group optionally substituted with up to three phenyl or hydroxy groups and optionally interrupted by up to four of the following structures:

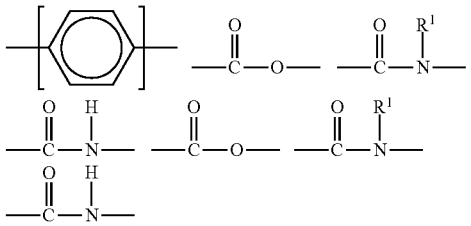

or an isomer or mixture of these structures, and which contains from 8 to 22 carbon atoms. The $R^1$ groups can additionally contain up to 12 ethoxy groups and m is a number from 1 to 3. Preferably, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y can be a group including, but not limited to:

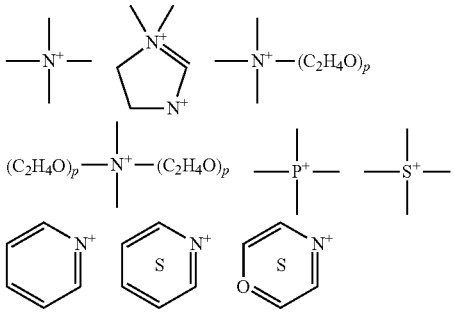

p = about 1 to 12 or a mixture thereof.

Preferably, L is 1 or 2, with the Y groups being separated by a moiety selected from $R^1$ and $R^2$ analogs (preferably alkylene or alkenylene) having from 1 to 22 carbon atoms and two free carbon single bonds when L is 2. Z is a water soluble anion, such as a sulfate, methylsulfate, hydroxide, or nitrate anion, particularly preferred being sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of the anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," Cosmetics & Toiletries, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with ethyl acetate. During alkylation, one or two carboxy-alkyl groups react to form a tertiary amine and an ether linkage with differing alkylating agents yielding different tertiary amines.

Long chain imidazole derivatives generally have the general formula:

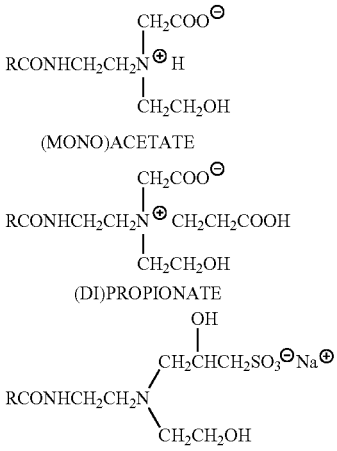

wherein R is an acyclic hydrophobic group containing from 8 to 18 carbon atoms and M is a cation to neutralize the charge of the anion, generally sodium. Commercially prominent imidazoline-derived amphoterics include for example: cocoamphopropionate, cocoamphocarboxy-propionate, cocoamphoglycinate, cocoamphocarboxy-glycinate, cocoamphopropyl-sulfonate, and cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which R is a $C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes include alkyl beta-amino dipropionates, $RN(C_2H_4COOM)_2$ and $RNHC_2H_4COOM$. In these, R is preferably an acyclic hydrophobic group containing from 8 to 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from 8 to 18 (preferably 12) carbon atoms. Such a surfactant can also be considered an alkyl amphodicarboxylic acid. Disodium cocoampho dipropionate is a preferred amphoteric surfactant and is commercially available under the tradename Miranol™ FBS from Rhodia Inc., Cranbury, N.J. Another preferred coconut derived amphoteric surfactant with the chemical name disodium cocoampho diacetate is sold under the tradename Miranol™ C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

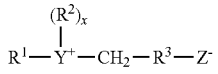

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane 1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The suitable zwitterionic surfactants include a betaine of the general structure:

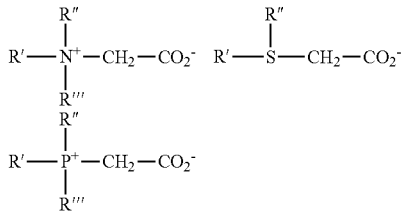

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Protease

The disclosed compositions include at least one protease derived from a plant, an animal, or a microorganism. The protease has been found to provide good protein removal on instruments and devices.

Preferably the protease is derived from a microorganism, such as a yeast, a mold, or a bacterium. Preferred proteases include serine proteases active at an alkaline pH, preferably derived from a strain of *Bacillus* such as *Bacillus subtilis* or *Bacillus licheniformis*; these preferred proteases include native and recombinant subtilisins. The protease can be purified or a component of a microbial extract, and either wild type or variant (either chemical or recombinant). A preferred protease is neither inhibited by a metal chelating agent (sequestrant) or a thiol poison nor activated by metal ions or reducing agents, has a broad substrate specificity, is inhibited by diisopropylfluorophosphate (DFP), is an endopeptidase, has a molecular weight in the range of about 20,000 to about 40,000, and is active at a pH of about 6 to about 12 and at temperatures in a range from about 20° C. to about 80° C.

Examples of proteolytic enzymes which can be employed in the cleaning composition of the invention include (with trade names) Savinase®; a protease derived from *Bacillus lentus* type, such as Maxacal®, Opticlean®, Durazym®, and Properase®; a protease derived from *Bacillus licheniformis*, such as Alcalase®, Maxatase®, Deterzyme®, or Deterzyme PAG 510/220; a protease derived from *Bacillus amyloliquefaciens*, such as Primase®; and a protease derived from *Bacillus alcalophilus*, such as Deterzyme APY. Exemplary commercially available protease enzymes include those sold under the trade names Alcalase®, Savinase®, Primase®, Durazym®, or Esperase® by Novo Industries A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean® or Optimase® by Solvay Enzymes; those sold under the tradenames Deterzyme®, Deterzyme APY, and Deterzyme PAG 510/220 by Deerland Corporation, and the like.

Preferred proteases will provide good protein removal and cleaning performance, will not leave behind a residue, and will be easy to formulate with and form stable products. Savinase®, commercially available from Novozymes, is a serine-type endo-protease and has activity in a pH range of 8 to 12 and a temperature range from 20° C. to 60° C. Savinase is preferred when developing a liquid concentrate. A mixture of proteases can also be used. For example, Alcalase®, commercially available from Novozymes, is derived from *Bacillus licheniformis* and has activity in a pH range of 6.5 to 8.5 and a temperature range from 45° C. to 65° C. And Esperase®, commercially available from Novozymes, is derived from *Bacillus* sp. and has an alkaline pH activity range and a temperature range from 50° C. to 85° C. A combination of Esperase and Alcalase is preferred when developing a solid concentrate because they form a stable solid. In some embodiments, the total protease concentration in the concentrate product is from about 1 to about 15 wt. %, from about 5 to about 12 wt. %, or from about 5 to about 10 wt. %. In some embodiments, there is at least 1-6 parts of Alcalase for every part of Esperase (e.g., Alcalase: Esperase of 1:1, 2:1, 3:1, 4:1, 5:1, or 6:1).

Detersive proteases are described in patent publications including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease is preferably at least 80% homologous, preferably having at least 80% sequence identity, with the amino acid sequences of the proteases in these references.

Mixtures of different proteolytic enzymes may be incorporated into the disclosed compositions. While various specific enzymes have been described above, it is to be understood that any protease which can confer the desired proteolytic activity to the composition may be used.

Additional Ingredients

The disclosed compositions can optionally include a variety of ingredients. Such ingredients include, but are not limited to a chelating or sequestering agent, a builder, a corrosion inhibitor, a defoamer, a solidifying agent, other enzymes, and a preservative, as well as pigments, dyes and fragrances. Water and other fillers may also be incorporated.

Such additional ingredients can be preformulated with the concentrate composition or added to the use composition. The disclosed compositions can also contain any number of other constituents, which are known to those of skill in the art.

Chelating Agents or Sequestrants

The disclosed compositions can optionally include a chelating agent or sequestrant. Exemplary chelating agents and sequestrants include alkyl diamine polyacetic acid-type chelating agents such as EDTA (ethylene diamine tetraacetate tetrasodium salt), acrylic and polyacrylic acid-type stabilizing agents, phosphonic acid, and phosphonate-type chelating agents among others. Preferable sequestrants include phosphonic acids and phosphonate salts including 1-hydroxyethylidene-1,1-diphosphonic acid ($CH_3C(PO_3H_2)_2$ OH) (HEDP), amino[tri(methylene phosphonic acid)] (ATMP), ethylene diamine[tetra methylene-phosphonic acid)], 2-phosphene butane-1,2,4-tricarboxylic acid (PBTC), as well as the alkyl metal salts, ammonium salts, or alkyloyl amine salts, such as mono, di, or tetra-ethanolamine salts.

Amino phosphates and phosphonates are also suitable as chelating agents and include ethylene diamine (tetramethylene phosphonates), nitrilotrismethylene phosphates, diethylenetriamine (pentamethylene phosphonates). These amino phosphonates commonly contain alkyl or alkaline groups with less than 8 carbon atoms. The phosphonic acid may also include a low molecular weight phosphonopolycarboxylic acid such as one having about 2-4 carboxylic acid moieties and about 1-3 phosphonic acid groups. Such acids include 1-phosphono-1-methyl succinic acid, phosphonosuccinic acid and 2-phosphonobutane-1,2,4-tricarboxylic acid.

Commercially available chelating agents include phosphonates sold under the trade name DEQUEST® including, for example, 1-hydroxyethylidene-1,1-diphosphonic acid, available from Monsanto Industrial Chemicals Co., St. Louis, Mo., as DEQUEST® 2010; amino(tri(methylenephosphonic acid)), ($N[CH_2PO_3H_2]_3$), available from Monsanto as DEQUEST® 2000; ethylenediamine[tetra(methylenephosphonic acid)] available from Monsanto as DEQUEST® 2041; and 2-phosphonobutane-1,2,4-tricarboxylic acid available from Mobay Chemical Corporation, Inorganic Chemicals Division, Pittsburgh, Pa., as Bayhibit AM; and amino[tri(methylene phosphonic acid)] (ATMP) available as Briquest 301-50A: Amino Tri (Methylene Phosphonic Acid) (ATMP), 50%, low ammonia from Albright & Wilson.

The above-mentioned phosphonic acids can also be used in the form of water soluble acid salts, particularly the alkali metal salts, such as sodium or potassium; the ammonium salts or the alkylol amine salts where the alkylol has 2 to 3 carbon atoms, such as mono-, di-, or triethanolamine salts. If desired, mixtures of the individual phosphonic acids or their acid salts can also be used.

Another chelating agent is phosphino succinate oligomers. In addition to chelating, this oligomer also has anticorrosion properties. Other exemplary chelating agents include polymers, and polycarboxylic acids such as hydroxyethylenediamineetriacetic acid (HEDTA), diethylenetriaminepentaacetic acid (DTPA), methylglycinediacetic acid (MGDA), glutamic-N,N-diacetic acid (GLDA), iminodisuccinic acid (IDSA), hydroxyiminodisuccinic acid (HIDS), ethylenediaminodisuccinic acid (EDDS), aspartic-N,N-diacetic acid (ASDA), and salts and mixtures thereof.

Builder

The disclosed compositions can optionally include a builder for purposes including assisting in controlling mineral hardness. Inorganic as well as organic builders can be used. The level of builder can vary widely depending upon the end use of the composition and its desired physical form.

Inorganic or phosphate-containing detergent builders include alkali metal, ammonium and alkanolammonium salts of polyphosphates (e.g. tripolyphosphates, pyrophosphates, and glassy polymeric meta-phosphates). Non-phosphate builders may also be used. These can include phytic acid, silicates, alkali metal carbonates (e.g. carbonates, bicarbonates, and sesquicarbonates), sulphates, aluminosilicates, monomeric polycarboxylates, homo or copolymeric polycarboxylic acids or their salts in which the polycarboxylic acid includes at least two carboxylic radicals separated from each other by not more than two carbon atoms, citrates, succinates, and the like. Preferred builders include citrate builders, e.g., citric acid and soluble salts thereof, due to their ability to enhance detergency of a soap or detergent solution and their availability from renewable resources and their biodegradability.

Corrosion Inhibitor

The disclosed compositions can optionally include a corrosion inhibitor. Exemplary corrosion inhibitors include an alkaline metal silicate or hydrate thereof. Exemplary alkali metal silicates include powdered, particulate or granular silicates which are either anhydrous or preferably which contain water of hydration (5 to 25 wt %, preferably 15 to 20 wt % water of hydration). These silicates include sodium silicates and have a $Na_2O:SiO_2$ ratio of about 1:1 to about 1:5, respectively, and typically contain available bound water in the amount of from 5 to about 25 wt %. In general, the silicates have a $Na_2O:SiO_2$ ratio of 1:1 to about 1:3.75, about 1:1.5 to about 1:3.75, or about 1:1.5 to about 1:2.5. A silicate with a $Na_2O:SiO_2$ ratio of about 1:2 and about 16 to 22 wt % water of hydration is preferred. Examples of commercially available silicates include the powder GD Silicate and the granulate Britesil H-20, from PQ Corporation. These ratios may be obtained with single silicate compositions or combinations of silicates which upon combination result in the preferred ratio. The hydrated silicates may have a $Na_2O:SiO_2$ ratio of about 1:1.5 to about 1:2.5.

Phosphino succinate oligomers are another exemplary corrosion inhibitor and also provide chelating properties.

Solidification Agent

The disclosed compositions can optionally include a solidification agent, which helps maintain the composition in a solid form.

Exemplary solidification agents include solid polyethylene glycol (PEG), solid polypropylene glycol, solid EO/PO block copolymer, amide, urea (also known as carbamide), nonionic surfactant (which can be employed with a coupler), starch that has been made water-soluble (e.g., through an acid or alkaline treatment process), cellulose that has been made water-soluble, inorganic agent, poly(maleic anhydride/methyl vinyl ether), polymethacrylic acid, other generally functional or inert materials with high melting points, mixtures thereof, and the like.

Exemplary glycol solidification agents include a solid polyethylene glycol or a solid polypropylene glycol, which can, for example, have molecular weight of about 1,400 to about 30,000. In certain embodiments, the solidification agent includes or is solid PEG, for example PEG 1500 up to PEG 20,000. In certain embodiments, the PEG includes PEG 1450, PEG 3350, PEG 4500, PEG 8000, PEG 20,000, and the like.

Exemplary amide solidification agents include stearic monoethanolamide, lauric diethanolamide, stearic diethanolamide, stearic monoethanol amide, cocodiethylene amide, an alkylamide, mixtures thereof, and the like.

Exemplary nonionic surfactant solidification agents include nonylphenol ethoxylate, linear alkyl alcohol ethoxylate, ethylene oxide/propylene oxide block copolymer, mixtures thereof, or the like. Exemplary ethylene oxide/propylene oxide block copolymers include those sold under the Pluronic tradename (e.g., Pluronic 108 and Pluronic F68) and commercially available from BASF Corporation. In some embodiments, the nonionic surfactant can be selected to be solid at room temperature or the temperature at which the composition will be stored or used. In other embodiments, the nonionic surfactant can be selected to have reduced aqueous solubility in combination with the coupling agent. Suitable couplers that can be employed with the nonionic surfactant solidification agent include propylene glycol, polyethylene glycol, mixtures thereof, or the like.

Exemplary inorganic solidification agents include phosphate salt (e.g., alkali metal phosphate), sulfate salt (e.g., magnesium sulfate, sodium sulfate or sodium bisulfate), acetate salt (e.g., anhydrous sodium acetate), borates (e.g., sodium borate), silicates (e.g., the precipitated or fumed forms (e.g., Sipernat 50® available from Degussa), carbonate salt (e.g., calcium carbonate or carbonate hydrate), other known hydratable compounds, mixtures thereof, and the like. In an embodiment, the inorganic solidification agent includes organic phosphonate compounds and carbonate salts.

The disclosed compositions can be made into solids in a number of ways, including by casting, extruding, pressing, and tableting. If the composition is formed by pressing, the composition may include solidification agents and binding agents, such as those described in US 2009/0102085 and US 2009/0105114, both of which are incorporated by reference herein in their entirety.

Other Enzymes

The disclosed compositions can optionally include different enzymes in addition to the protease. Exemplary enzymes include amylase, lipase, cellulase, and others.

Amylase

Exemplary amylase enzymes can be derived from a plant, an animal, or a microorganism. The amylase may be derived from a microorganism, such as a yeast, a mold, or a bacterium. Exemplary amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant).

Exemplary amylase enzymes include those sold under the trade name Rapidase by Gist-Brocades® (Netherlands); those sold under the trade names Termamyl®, Fungamyl® or Duramyl® by Novo; those sold under the trade names Purastar STL or Purastar OXAM by Genencor; those sold under the trade names Thermozyme® L340 or Deterzyme® PAG 510/220 by Deerland Corporation; and the like. A mixture of amylases can also be used.

Cellulases

Exemplary cellulase enzymes can be derived from a plant, an animal, or a microorganism, such as a fungus or a bacterium. Cellulases derived from a fungus include the fungus *Humicola insolens, Humicola* strain DSM1800, or a cellulase 212-producing fungus belonging to the genus *Aeromonas* and those extracted from the hepatopancreas of a marine mollusk, *Dolabella Auricula Solander*. The cellulase can be purified or a component of an extract, and either wild type or variant (either chemical or recombinant).

Examples of cellulase enzymes include those sold under the trade names Carezyme® or Celluzyme® by Novo; under the tradename Cellulase by Genencor; under the tradename Deerland Cellulase 4000 or Deerland Cellulase TR by Deerland Corporation; and the like. A mixture of cellulases can also be used.

Lipases

Exemplary lipase enzymes can be derived from a plant, an animal, or a microorganism, such as a fungus or a bacterium. Exemplary lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Exemplary lipase enzymes include those sold under the trade names Lipase P "Amano" or "Amano-P" by Amano Pharmaceutical Co. Ltd., Nagoya, Japan or under the trade name Lipolase® by Novo, and the like. Other commercially available lipases include Amano-CES, lipases derived from *Chromobacter viscosum*, e.g. *Chromobacter viscosum* var. lipolyticum NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa*. A preferred lipase is sold under the trade name Lipolase® by Novo. A mixture of lipases can also be used.

Additional Enzymes

Additional suitable enzymes include a cutinase, a peroxidase, a gluconase, and the like. Exemplary cutinase enzymes are described in WO 8809367 A to Genencor. Exemplary peroxidases include horseradish peroxidase, ligninase, and haloperoxidases such as chloro- or bromo-peroxidase. Exemplary peroxidases are also disclosed in WO 89099813 A and WO 8909813 A to Novo.

These additional enzymes can be derived from a plant, an animal, or a microorganism. The enzyme can be purified or a component of an extract, and either wild type or variant (either chemical or recombinant). Mixtures of different additional enzymes can be used.

Foam Inhibitors or Defoamers

The disclosed compositions can optionally include a foam inhibitor or defoamer for reducing the stability of any foam that is formed, especially when anionic surfactants are included in the formulation.

Examples of foam inhibitors include silicon compounds such as silica dispersed in polydimethylsiloxane, fatty amides, amides, hydrocarbon waxes, fatty acids and soaps thereof, fatty esters, fatty alcohols, fatty acid soaps, sulfates and sulfonates, ethoxylates, vegetable oils, mineral oils and their sulfonated or sulfated derivatives, polyethylene glycol esters, polyoxyethylene-polyoxypropylene block copolymers, alkyl phosphates and phosphate esters such as alkyl and alkaline diphosphates, tributyl phosphates, and monostearyl phosphate, halogenated compounds such as fluorochlorohydrocarbons, and the like. As discussed in the section on surfactants, certain surfactants can be selected to take advantage of the surfactant cloud point in a way where the surfactant contributes to cleaning and defoaming. An example of a commercially available linear alcohol ethoxylate is Triton DF-12, which is commercially available from Dow.

Preservatives

The disclosed compositions can optionally include a preservative to extend the storage life of the product and prevent or slow changes in the odor, color, texture, or appearance of the product. The preservative can provide inhibitory or bacteriostatic properties to the disclosed compositions without providing lethal antimicrobial activity that results in partial or complete microbial destruction.

Exemplary preservatives include the antimicrobial classes such as phenolics, quaternary ammonium compounds, metal derivatives, amines, alkanol amines, nitro derivatives, analides, organosulfur and sulfur-nitrogen compounds and miscellaneous compounds. Exemplary phenolic agents include pentachlorophenol, orthophenylphenol. Exemplary quaternary antimicrobial agents include benzalconium chloride, cetylpyridiniumchloride, amine and nitro containing antimicrobial compositions such as hexahydro-1,3,5-tris(2-hydroxyethyl)-s-triazine, dithiocarbamates such as sodium dimethyldithiocarbamate, and a variety of other materials known in the art for their microbial properties. Other exemplary preservatives include isothiazolones such as CMIT and MIT, gluteraldehyde, Bronopol, and silver.

Dyes and Fragrances

The disclosed compositions can optionally include various dyes, odorants including perfumes, and other aesthetic enhancing agents.

Dyes may be included to alter the appearance of the composition, as for example, Violet Dye 148 (Keycolour), Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like. Fragrances or perfumes that may be included in the compositions include, for example, terpenoids such as citronellol, aldehydes such as amyl cinnamaldehyde, a jasmine such as C1S-jasmine or jasmal, vanillin, and the like.

Methods of Use

The disclosed compositions can be employed in a variety of methods disclosed for cleaning, washing, or presoaking medical or dental devices, instruments, or equipment, including any of the various medical or dental instruments or devices that can benefit from cleaning with enzyme cleaning composition. Exemplary medical and dental instruments and devices include instruments, devices, tools, appliances, apparatus, and equipment used in medicine or dentistry including those than can be cold sterilized, soaked or washed and then heat sterilized, or otherwise benefit from cleaning in the disclosed compositions. These various instruments, devices and equipment include, but are not limited to: diagnostic instruments, trays, pans, holders, racks, forceps, scissors, shears, saws (e.g. bone saws and their blades), hemostats, knives, chisels, rongeurs, files, nippers, drills, drill bits, rasps, burrs, spreaders, breakers, elevators, clamps, needle holders, carriers, clips, hooks, gouges, curettes, retractors, straightener, punches, extractors, scoops, keratomes, spatulas, expressors, trocars, dilators, cages, glassware, tubing, catheters, cannulas, plugs, stents, arthoscopes and related equipment, and the like, or combinations thereof.

The disclosed compositions can be used to process the device, instrument, or equipment by presoaking, such as in a tray, tub, pan, or sink, spraying such as through an instrument washer, ultrasonic treatment, treatment in a cart or cage washer, manually applying it with a hand-held bottle as either a spray or a foam, and mechanized washing including in a laboratory glass machine washer.

Manual Presoak Method

When used as a manual presoak, soiled medical or dental instruments, medical devices, or portions of medical devices are contacted with an effective amount of the disclosed compositions. The actual amount of composition used will be based on the judgment of user, and will depend upon factors such as the particular product formulation of the composition, the concentration of the composition, the number of soiled articles to be presoaked and the degree of soiling of the articles. Subsequently, the items may be subjected to a manual or machine washing or rinsing method, involving either further washing steps and use of a detergent composition, and/or to a manual or machine rinsing method. The disclosed compositions and methods are effective at removing the soils on instruments by reducing the amount of scrubbing required in the cleaning process. The disclosed compositions and methods also provide low foam or no foam allowing for visual inspection of the articles to monitor the cleaning process and provide safe handling of the articles.

Machine Wash or Presoak Method

The disclosed compositions also can be employed in a variety of machines that wash or soak instruments, such as medical or dental instruments or devices. Such machines can be charged manually with powder or other solid forms of the composition. Such machines can also automatically dispense the disclosed compositions. Such dispensing can include dissolving the cleaning composition to form a first liquid concentrate composition, optionally diluting the first liquid concentrate composition to yield a second liquid concentrate composition (that is less concentrated), and diluting the second liquid concentrate composition into the wash or soak chamber to form the use composition. The use composition can be used to wash or soak the instruments. Such dispensing can also include dissolving a solid cleaning composition once to form a use solution.

In addition to cleaning medical and dental instruments and devices, the disclosed compositions can also be used to clean other surfaces, including food preparation equipment such as freezers, ovens, conveyors, portioners, slabbers, trimmers, slicers, hoppers, graders, scales, packaging equipment, blades, knives, meat saws, and other kitchen tools. The disclosed compositions could also be used in manual and automatic dishwashing and warewashing applications, as a pre-soak for dishes and wares, as a detergent in a powersink application, which is an open washing device with low pressure jets, and as a hard surface cleaner for use in kitchens, delis, grocery stores, butcher shops, bakeries, restaurants, and cold storage areas. It can also be used as a hard surface cleaner for glass such as that found in food retail spaces, drains, bathroom surfaces, clean-in-place equipment, tanker and delivery vehicle cleaning, and bottle washing. The disclosed compositions can be used to clean soft surfaces such as drapes, laundry, carpet, and upholstery. Finally, the disclosed compositions can be used in water treatment to help remove protein deposits in water treatment equipment and to clean membranes.

The following examples and test data provide an understanding of certain specific embodiments. The examples are not meant to limit the scope that has been set forth in the foregoing description. Variations within the disclosed concepts are apparent to those skilled in the art.

EXAMPLES

Example 1

Example 1 determined the cleaning efficacy of the protease enzymes Alcalase® Esperase®, and Savinase® 16L, all commercially available from Novozymes. For this example, protein coupons were prepared by placing 100 g of ground chicken with a 60:40 ratio of protein to fat in a blender with 100 g of deionized water. The chicken was blended and strained through fabric to provide a consistency of yogurt. Approximately 0.1 g of this strained soil was placed on a 3×5 stainless steel coupon to cover 100% of the coupon surface and allowed to dry overnight. Once the coupons were prepared, they were weighed. The test solution was prepared and placed into a 1000 ml beaker. One soiled coupon was placed in the beaker for 5 minutes. After 5 minutes, the coupon was removed and gently rinsed with deionized water. The cleaned coupon was allowed to dry vertically overnight. Once dry the coupon was weighed. The coupon was then dyed blue with Coomassie Blue stain to highlight any remaining protein soil. Image Analysis was used to quantitate the amount of soil remaining. A Fiji Image J (open source) imaging analysis software was used to analyze the coupons after cleaning and soiling procedures using identical color adjustment factors to distinguish between area % of colored sections (still containing soil) and area % of non-colored sections (where the soil has been removed by the cleaning process). The % soil removal was calculated by subtracting the % area soiled from 100. Image analysis demonstrates amount of coupon where soil was completely removed. Determination that an area is 100% cleaned of protein and fat soils differs from a weight analysis, which only measures bulk removal but not complete removal from a soiled surface.

The following formula was stored at 40° C. for 0, 1, 2, and 3 weeks and then tested for protein removal to determine the stability of the enzyme in the block.

Formula 1

| Raw Material | % Concentrate |
|---|---|
| Savinase 16L | 4 |
| PEG 4000 | 15 |
| Calcium Chloride | 1.25 |
| Magnesium Chloride | 1.05 |
| Proxel GXL | 0.15 |
| Violet Dye 148 | 0.4 |
| Antifoam 544 | 3 |
| Glucopon 50G | 15.5 |
| Sodium Bicarbonate | 26 |
| Sodium Sulfate | 22.15 |
| Sodium Silicate | 8 |
| Sodium Polyacrylate | 3.5 |

2.5 grams of Formula 1 was dissolved into a gallon of water to form a use solution and the coupons were allowed to soak in the use solution.

The results are shown in Table 1.

TABLE 1

Formula 1 Stability in a Solid Block

| Stability Week | 0 | 1 | 2 | 3 |
|---|---|---|---|---|
| % Soil Removal | 58.3537 | 24.9140 | 33.9687 | 8.9255 |
| Storage Temp (C.) | 40 | 40 | 40 | 40 |
| Soak Temp (C.) | 30 | 30 | 30 | 30 |
| Soak Time (min) | 5 | 5 | 5 | 5 |

The results show that the 4% Savinase 16L has good initial cleaning efficacy, but was not stable in a solid block after three weeks.

The following formulas were prepared and tested.

Formulas 2-9

| | % Use Formula | | | | | | | |
|---|---|---|---|---|---|---|---|---|
| | 2 | 3 | 4 | 5 | 6 | 7 | 8 | 9 |
| Savinase 16L | 0.0050 | | | | | | | |
| Savinase 16T Type W | | 0.0050 | | | | | | |
| Alcalase | | | 0.0066 | 0.0066 | 0.0066 | 0.0033 | 0.0033 | 0.0099 |
| Esperase | | | 0.0099 | 0.0066 | 0.0033 | 0.0033 | 0.0066 | 0.0066 |
| Sodium Bicarbonate | 0.0340 | 0.0340 | 0.0172 | 0.0172 | 0.0172 | 0.0172 | 0.0172 | 0.0172 |
| Barlox 1260 | 0.0053 | 0.0053 | | | | | | |
| Barlox 16S | 0.0073 | 0.0073 | | | | | | |
| Glucopon 50G | | | 0.0102 | 0.0102 | 0.0102 | 0.0102 | 0.0102 | 0.0102 |
| Sodium Silicate | 0.0053 | 0.0053 | 0.0053 | 0.0053 | 0.0053 | 0.0053 | 0.0053 | 0.0053 |
| PEG 4000 | 0.0119 | 0.0119 | 0.0099 | 0.0099 | 0.0099 | 0.0099 | 0.0099 | 0.0099 |
| Sodium Polyacrylate | 0.0046 | 0.0046 | 0.0023 | 0.0023 | 0.0023 | 0.0023 | 0.0023 | 0.0023 |
| SAG 30 | 0.0046 | 0.0046 | 0.0020 | 0.0020 | 0.0020 | 0.0020 | 0.0020 | 0.0020 |
| Sodium Sulfate | 0.0532 | 0.0532 | 0.0099 | 0.0099 | 0.0099 | 0.0099 | 0.0099 | 0.0099 |
| Proxel GXL | 0.0002 | 0.0002 | 0.0001 | 0.0001 | 0.0001 | 0.0001 | 0.0001 | 0.0001 |
| FDC Blue #1 | 0.0001 | 0.0001 | | | | | | |
| Violet Dye 148 | | | 0.0003 | 0.0003 | 0.0003 | 0.0003 | 0.0003 | 0.0003 |

The results are shown in Table 2.

TABLE 2

| Savinase vs. Alcalase/Esperase Ratio | | | |
|---|---|---|---|
| Formula | % Soil Removal | Soak Temp (C.) | Soak Time (min) |
| 2 | 95.0963 | 30 | 5 |
| 3 | 63.6147 | 20 | 3 |
| 4 | 90.792 | 30 | 5 |
| 5 | 92.8893 | 30 | 5 |
| 6 | 92.4887 | 30 | 5 |
| 7 | 50.1933 | 30 | 5 |
| 8 | 61.8437 | 30 | 5 |
| 9 | 93.3393 | 30 | 5 |

Formula 6 (2:1 Alcalase:Esperase) has similar performance to Formula 2 (Savinase). Decreasing the amount of Alcalase in comparison to Esperase reduced the cleaning performance (Formulas 7 and 8).

Finally, the following formula was stored at 40° C. for 0, 1, 2, 3, and 4 weeks and then tested for fat removal to determine the stability of the enzyme in the block.

Formula 10

| Raw Material | % Concentrate |
|---|---|
| Esperase | 2 |
| Alcalase | 12 |
| Sodium Bicarbonate | 25 |
| Triton DF-12 | 7 |
| Sodium Silicate | 7.5 |
| PEG 4000 | 15 |
| Sodium Polyacrylate | 3.5 |
| Sodium Citrate | 7 |
| Sodium Sulfate | 20.75 |
| Proxel GXL | 0.15 |
| Violet Dye 148 | 0.1 |

2.5 grams of Formula 10 was dissolved in 1 gallon of water to form a use solution and the coupons were placed in the use solution. The results are shown in Table 3.

TABLE 3

| Formula 10 Stability in a Solid Block | | | | | |
|---|---|---|---|---|---|
| Stability Week | 0 | 1 | 2 | 3 | 4 |
| % Soil Removal | 77.755667 | 84.024667 | 67.296333 | 75.026 | 81.813 |
| Storage Temp (C.) | 40 | 40 | 40 | 40 | 40 |
| Soak Temp (C.) | 30 | 30 | 30 | 30 | 30 |
| Soak Time (min) | 5 | 5 | 5 | 5 | 5 |

Table 3 shows that Formula 10 was stable over time.

Example 2

Example 2 compared three surfactants based on cleaning efficacy against fat soils. This example compared Triton DF-12, a linear alcohol ethoxylate surfactant commercially available from Dow, Glucopon 50G, an alkyl polyglucoside surfactant commercially available from Cognis, and Pluronic N-3, a propoxy ethoxy surfactant commercially available from BASF.

| | % Use | | |
|---|---|---|---|
| Formula | 11 | 12 | 13 |
| Esperase | 0.0013 | 0.0013 | 0.0013 |
| Alcalase | 0.0079 | 0.0079 | 0.0066 |
| Sodium Bicarbonate | 0.0132 | 0.0132 | 0.0066 |
| Triton DF-12 | 0.0046 | | |
| Pluronic N-3 | | 0.0050 | |
| Glucopon 50G | | | 0.0099 |
| Sodium Silcate | 0.0053 | 0.0053 | 0.0053 |
| PEG 4000 | 0.0099 | 0.0099 | 0.0100 |
| Acusol 445ND | 0.0023 | 0.0023 | 0.0023 |
| Sodium Citrate | 0.0069 | 0.0069 | |
| Sodium Sulfate | 0.0144 | 0.0144 | 0.0205 |
| Proxel GXL | 0.0001 | 0.0001 | 0.0001 |
| Violet Dye 148 | 0.0001 | 0.0001 | 0.0003 |

For this test, the same soiling and cleaning procedure was used as in Example 1, except that instead of the chicken soil, 100% lard was used to soil the coupons. The results are shown in Table 4.

TABLE 4

| Formula | 11 | 12 | 13 |
|---|---|---|---|
| % in Use | 0.0046 | 0.0046 | 0.0099 |
| % Soil Removal | 43.046 | 40.8837 | 11.3787 |
| Soak Time (min) | 5 | 5 | 5 |
| Soak Temp (C.) | 30 | 30 | 30 |

The results show that Triton DF-12 (Formula 11) provided the best cleaning performance.

Example 3

Example 3 determined the effect of various formulations on corrosion of Al 7075 grade aluminum. For this example, ASTM test method G1, Standard Practice for Preparing, Cleaning, and Evaluating Corrosion Test Specimens, was used to prepare coupons for the corrosion test. Once the coupons were prepared, ASTM G31, Standard Practice for Laboratory Immersion Corrosion Testing of Metals, was used for soaking the coupons in the desired cleaning solution. For the soak, the coupons were allowed to sit in the cleaning solution for 8 hours at 50° C. The coupons were allowed to soak in 8 ounce square glass jars. The weight of the coupons was measured before and after soaking and the MPY was calculated and recorded in Table 5. The experimental formulas were compared against a water control and AseptiZyme Multi, a commercially available product from Ecolab Inc.

Formulas 14-20

| | % Concentrate Formula | | | | | | |
|---|---|---|---|---|---|---|---|
| | 14 | 15 | 16 | 17 | 18 | 19 | 20 |
| Esperase | 2 | 2 | 2 | 2 | 2 | | |
| Alcalase | 12 | 12 | 12 | 12 | 12 | | |
| Sodium Bicarbonate | 25 | 25 | 25 | 25 | 25 | | |
| Triton DF-12 | 7 | 7 | 7 | 7 | 7 | | |
| Sodium Silicate | 7.5 | — | — | — | — | | |
| Sodium Metasilicate Pentahydrate | — | 7.5 | — | — | — | | |
| Sodium Metasilicate | — | — | 7.5 | — | — | | |

-continued

| | % Concentrate Formula | | | | | | |
|---|---|---|---|---|---|---|---|
| | 14 | 15 | 16 | 17 | 18 | 19 | 20 |
| Anhydrous Sodium Gluconate | — | — | — | 7.5 | — | | |
| PEG 4000 | 15 | 15 | 15 | 15 | 15 | | |
| Sodium Polyacrylate | 3.5 | 3.5 | 3.5 | 3.5 | 3.5 | | |
| Sodium Citrate | 7 | 7 | 7 | 7 | 7 | | |
| Sodium Sulfate | 20.75 | 20.75 | 20.75 | 20.75 | 20.75 | | |
| Proxel GXL | 0.15 | 0.15 | 0.15 | 0.15 | 0.15 | | |
| Violet Dye 148 | 0.1 | 0.1 | 0.1 | 0.1 | 0.1 | | |
| AseptiZyme Multi Enzymatic Manual Cleaner | | | | | | ¾ oz/gal | |
| 0GPG Water | | | | | | | 100 |

The results are shown in Table 5.

TABLE 5

| Formula | Dose | Replicates | MPY | Average MPY |
|---|---|---|---|---|
| 14 | 2.5 g/gal | 1 | 8.642129 | 5.230692 |
| | | 2 | 6.26443 | |
| | | 3 | 0.785518 | |
| 15 | 2.5 g/gal | 1 | 2.359673 | 6.024856 |
| | | 2 | 8.646411 | |
| | | 3 | 7.068484 | |
| 16 | 2.5 g/gal | 1 | 7.068484 | 5.240686 |
| | | 2 | −1E−11 | |
| | | 3 | 8.653574 | |
| 17 | 2.5 g/gal | 1 | 10.98093 | 8.109716 |
| | | 2 | 9.419979 | |
| | | 3 | 3.92824 | |
| 18 | 2.5 g/gal | 1 | 0 | 1.309849 |
| | | 2 | 0 | |
| | | 3 | 3.929546 | |
| 19 | ¾ oz/gal | 1 | 3.950441 | 5.912621 |
| | | 2 | 7.8748 | |
| 20 | NA | 1 | 5.49229 | 5.497074 |
| | | 2 | 8.639258 | |
| | | 3 | 2.359673 | |

The results show that the experimental formulas (Formulas 14-18) have similar corrosion inhibition to the commercially available product (Formula 19).

What is claimed is:

1. A method of cleaning a medical or dental instrument comprising:

a) dissolving a solid composition in water to form a use solution, the solid composition consisting essentially of:

i) from about 0.1 wt. % to 30 wt. % of a mixture of a first protease and a second protease different from the first protease, wherein the first and second proteases are derived from different species or strains of *Bacillus*, and the mixture comprises at least 4 parts of the first protease for every 1 part of the second protease, ii) from about 0.1 wt. % to about 50 wt. % of a carbonate salt, iii) from about 1 wt. % to 25 wt. % nonionic surfactant; and iv) optionally, one or more additional materials selected from sulfate salts, solidifying agents, chelating agents, sequestrants, builders, fillers, corrosion inhibitors, defoaming agents, additional enzymes, preservatives, dyes, fragrances, water, and mixtures thereof;

b) soaking the instrument in the use solution for at least 10 seconds; and c) rinsing the instrument.

2. The method of claim 1, wherein at least one of the first or second protease is Alcalase or Savinase.

3. The method of claim 1, wherein the first protease and the second protease are present in a ratio from about 4:1 to about 6:1.

4. The method of claim 1, wherein the nonionic surfactant is a $C_6$ to $C_{20}$ alcohol alkoxylate with 2 to 14 moles of ethoxylation.

5. The method of claim 1, wherein the surfactant has a cloud point between 10 and 50° C.

6. The method of claim 1, wherein the corrosion inhibitor is present in the solid composition and the corrosion inhibitor is a powdered silicate.

7. The method of claim 1, wherein the pH of the use solution is from about 6 to about 9.

8. The method of claim 1, where the instrument is selected from the group consisting of forceps, scissors, shear, saw, hemostat, knife, chisel, rongeur, file, nipper, drill, drill bit, rasp, burr, spreader, breaker, clamp, needle holder, carrier, clip, hook, gouge, curette, retractor, straightener, punch, extractor, scoop, keratome, expressor, trocar, dilator, cage, catheter, cannula, plug, stent, arthoscope, and combinations thereof.

9. The method of claim 1, wherein the instrument is soaked for up to 5 minutes.

10. The method of claim 1, wherein the sulfate salt is selected from the group consisting of magnesium sulfate, sodium sulfate, sodium bisulfate, and mixtures thereof.

11. The method of claim 5, wherein a temperature of the use solution is above the cloud point of the surfactant.

12. The method of claim 10, wherein the sulfate salt is present in the solid composition in a concentration of from 20 wt. % to 50 wt. %.

* * * * *